US005955409A

United States Patent [19]

Farrell et al.

[11] Patent Number: 5,955,409

[45] **Date of Patent: *Sep. 21, 1999**

[54] BAR COMPOSITIONS COMPRISING ADJUVANT POWDERS FOR DELIVERING BENEFIT AGENT

[75] Inventors: Terence Farrell, West New York; David Quinn, N. Arlington; Gregory McFann, E. Rutherford; Gail Beth Rattinger, Teaneck; Liang Sheng Tsaur, Norwood, all of N.J.

[73] Assignee: Lever Brothers Company, New York, N.Y.

[ * ] Notice: This patent is subject to a terminal disclaimer.

[21] Appl. No.: 08/821,502

[22] Filed: Mar. 21, 1997

[51] Int. Cl.[6] ..... C11D 17/00

[52] U.S. Cl. ..... 510/141; 510/151; 510/152; 510/155; 510/156; 510/440; 510/443; 510/447; 510/450; 510/451; 510/452; 510/470; 510/474; 510/475; 510/501; 510/504

[58] Field of Search ..... 510/447, 130, 510/141, 151, 152, 155, 156, 440, 450, 451, 470, 474, 475, 501, 504

[56] References Cited

U.S. PATENT DOCUMENTS

| | | | |
|---|---|---|---|
| 3,761,418 | 9/1973 | Parran, Jr. | 510/382 |
| 4,100,097 | 7/1978 | O'Roark | 510/151 |
| 4,124,521 | 11/1978 | Jedzinak | 510/151 |
| 4,169,067 | 9/1979 | Joshi | 510/153 |
| 4,276,312 | 6/1981 | Merritt | 426/96 |
| 4,673,525 | 6/1987 | Small | 510/151 |
| 4,749,501 | 6/1988 | Nakagawa et al. | 510/130 |
| 4,788,006 | 11/1988 | Bolich, Jr. et al. | 510/121 |
| 4,808,322 | 2/1989 | McLaughlin | 510/151 |
| 4,820,447 | 4/1989 | Medcalf | 510/151 |
| 4,941,990 | 7/1990 | McLaughlin | 510/151 |
| 5,037,818 | 8/1991 | Sime | 514/183 |
| 5,096,608 | 3/1992 | Small | 510/153 |
| 5,154,849 | 10/1992 | Visscher et al. | 510/150 |
| 5,206,019 | 4/1993 | Nichols | 424/401 |
| 5,225,097 | 7/1993 | Kacher et al. | 510/146 |
| 5,418,010 | 5/1995 | Janda et al. | 427/213.31 |
| 5,520,840 | 5/1996 | Massaro et al. | 510/151 |
| 5,540,854 | 7/1996 | Fair et al. | 510/152 |
| 5,661,120 | 8/1997 | Finucane et al. | 510/153 |
| 5,683,973 | 11/1997 | Post et al. | 510/152 |
| 5,691,287 | 11/1997 | Villars et al. | 510/151 |

FOREIGN PATENT DOCUMENTS

| | | |
|---|---|---|
| 0061701 | 10/1982 | European Pat. Off. . |
| 94/03152 | 2/1994 | WIPO . |

*Primary Examiner*—Lorna Douyon
*Attorney, Agent, or Firm*—Ronald A. Koatz

[57] ABSTRACT

Adjuvant powder compositions contain a benefit agent or benefit agents and enhance the delivery of these benefit agent or agents when used as a separate adjuvant during preparation of bar compositions. Carriers used in the formation of the adjuvants must have a melting point high enough to survive a spray-drying process.

12 Claims, No Drawings

BAR COMPOSITIONS COMPRISING ADJUVANT POWDERS FOR DELIVERING BENEFIT AGENT

FIELD OF THE INVENTION

The present invention relates to bar compositions, particularly synthetic bar compositions, better able to deliver beneficial agents. In particular, the invention relates to powder adjuvants comprising (a) benefit agents, (b) a carrier (e.g., soluble or partially soluble starches, water soluble amorphous solids or semi-crystalline water soluble solids), (c) water and (d) optional deposition/processing aids; wherein said adjuvant powders are mixed with bar chips prior to milling, extruding and stamping the bars.

BACKGROUND OF THE INVENTION

It is difficult to formulate personal wash bars which can deliver sufficient skin benefit agent to provide a perceivable skin benefit and which does not at the same time affect bar processing (e.g., benefit agent may be sticky and clog machinery or may be of high viscosity and render bar composition difficult to extrude) and/or affect bar user properties (e.g., foaming).

For example, generally water insoluble benefit agents tend to reduce lather performance. Further, even when they are incorporated, efficient deposition of water insoluble skin benefit agents onto skin from bars is difficult because of high levels of water insoluble particles such as fatty acids or waxes in the bar which can compete with the benefit agent particles or inhibit deposition of desired water insoluble benefit agent on the skin.

Unexpectedly, applicants have found that when the benefit agent is delivered in the form of an adjuvant powder comprising (1) benefit agent; (2) a water soluble (or at least partially soluble) carrier; (3) water and (4) optionally a deposition/processing aid selected from the group consisting of surfactants (e.g., cocoamidosulfosuccinate, aldobionamide), cationic polymers (e.g., Merquat® 100) and hydrophilic polymers (e.g., higher molecular weight polyalkylene glycols), applicants can enhance deposition of the benefit agent (approaching levels as high as those using shower gels instead of bars) without compromising processing (and in some cases aiding processing), and further without compromising user properties such as lather volume.

Use of certain deposition polymers (e.g., cationic polymers) to enhance deposition of a water insoluble particle (e.g., an emollient oil such as silicone) is known in the context of deposition from liquid shampoo onto hair. U.S. Pat. No. 5,037,818 to Sime, for example, teaches cationics to enhance deposition on hair from shampoos.

WO 94/03152 (assigned to Unilever PLC) teaches liquid cleansers that can effectively deposit silicone oil on skin using cationic polymers.

U.S. Pat. No. 4,788,006 to Bolich, Jr. et al. teaches shampoos with silicone particles of 2 to 50 micrometers which compositions contain xanthan gum to condition hair.

The above references, however, do not teach the deposition of benefit agent from bars. Further, the references do not teach or suggest powder adjuvants comprising a benefit agent plus specific spray-dryable carrier (as well as optional deposition/processing aid which may include cationic polymers); nor do they teach or suggest combining such powder adjuvants with bar chips to form bars.

The art also discloses personal washing bars comprising cationic polymer to provide a skin conditioning affect and/or mildness (see U.S. Pat. Nos. 4,673,525 to Small et al.; U.S. Pat. No. 4,820,447 to Medcalf, Jr. et al.; and 5,096,608 to Small et al.). In these references, the cationic polymer is not used in combination with a benefit agent to form a spray dry powder adjuvant as described in the subject invention.

U.S. Pat. No. 3,761,418 to Parran, Jr. discloses detergent compositions containing both water insoluble particulate substances and cationic polymers to enhance deposition and retention of particulate substances on surface washed with the detergent composition. Specifically, enhanced deposition of antimicrobial from toilet detergent bar using cationic polymers is disclosed. Again, the reference does not teach or suggest the use of the adjuvant powder of the invention (which must contain a carrier and optionally comprises cationic polymer) for enhanced deposition of benefit agent.

In applicants copending application, U.S. Ser. No. 08/821,504 filed on the same date as the subject application and entitled "Method for Enhancing Deposition from Bars Comprising Use of Bar Adjuvant Powder Compositions Comprising Benefit Agent and Deposition Polymer", now U.S. Pat. No. 5,858,939 applicants teach bars made from an adjuvant powder which comprises cationic polymer. The adjuvants of that invention are not limited to comprise carrier with melting point above 80° C., preferably above 100° C. because that application is directed more broadly to the concept of first creating benefit containing adjuvants (also comprising cationic deposition aids) and coextruding with chips, any process can be used (free-drying; spray-drying). By contrast, the carrier of the subject invention must have minimum melting point in order to survive spray drying process.

BRIEF SUMMARY OF THE INVENTION

The present invention relates to bar compositions in which 1% to 30% by wt. powder composition, preferably 5% to 25%, more preferably 10% to 25% of the powder composition is mixed with 99% to 70%, preferably 95% to 75% "conventional" bar chips comprising 5% to 90% of a surfactant system. The adjuvant powder composition and the chips are mixed together and extruded to form bar compositions able to deliver benefit agent to the skin in concentrations far higher than previously possible.

Specifically, the invention relates to bar compositions comprising about 1% to 30% powder (resulting in about 10% loading) comprising:

(a) 1% to 70% by wt. powder benefit agent;

(b) 15% to 98% by wt. powder carrier;

(c) 1% to 10% by wt. powder water; and (d) 0% to 30% by wt. powder deposition/processing aid (e.g., surfactant, cationic polymer and/or hydrophilic polymer); and 99% to 70% chips comprising 5% to 90% of a surfactant system wherein the surfactant is selected from the group consisting of soap, anionic surfactant, nonionic surfactant, amphoteric surfactant, cationic surfactant and mixtures thereof.

The amount of loading of benefit agent in final bar (e.g., about 10%) depends on the percent of the powder which the benefit agent comprises. For example, if the powder is 50% benefit agent oil, then it will require 20% powder (and 80% chips) to achieve 10% loading (i.e., 50% of 20%). If only 25% of powder were benefit agent, to achieve 10% loading in final bar would require 40% powder (25% of 40%) mixed with 60% chips.

DETAILED DESCRIPTION OF THE INVENTION

The present invention relates to bar compositions which are able to deliver greater amounts of benefit agent to skin or other substrate than has previously been possible with bar compositions. More specifically, by preparing adjuvant powders containing desired benefit agents, and coextruding the benefit agent containing powder with surfactant containing "regular" chips, bars can be prepared which bars deliver relatively large amounts of the benefit agent to the skin.

Thus, the invention relates to benefit agent containing powders having specific, novel formulation (i.e., benefit agent, generally added as an emulsion; generally water soluble carrier; water; and optional deposition/processing aids); and to bars prepared by coextruding these adjuvant powders and surfactant-containing "regular" chips.

1. BENEFIT AGENT CONTAINING POWDER

The benefit agent powders of the invention comprise a benefit agent "composition" (usually, although not necessarily, applied in combination with an emulsifier as an emulsion); a generally water soluble carrier; water; and optional deposition/processing aid. As described below, these components are generally mixed to form a slurry and dried (e.g., in a spray drier) to form a powder. Each component is described in greater detail below.

Benefit Agent Composition

The benefit agent "composition" of the subject invention may be a single benefit agent component or it may be a benefit agent compound added via a carrier. Further the benefit agent composition may be a mixture of two or more compounds one or all of which may have a beneficial aspect. In addition, the benefit agent itself may act as a carrier for other components one may wish to add to the bar composition.

The benefit agent can be an "emollient oil" by which is meant a substance which softens the skin (stratum corneum) by increasing into water content and keeping it soft by retarding decrease of water content.

Preferred emollients include:

(a) silicone oils, gums and modifications thereof such as linear and cyclic polydimethylsiloxanes; amino, alkyl alkylaryl and aryl silicone oils;

(b) fats and oils including natural fats and oils such as jojoba, soybean, rice bran, avocado, almond, olive, sesame, persic, castor, coconut, mink oils; cacao fat; beef tallow, lard; hardened oils obtained by hydrogenating the aforementioned oils; and synthetic mono, di and triglycerides such as myristic acid glyceride and 2-ethylhexanoic acid glyceride;

(c) waxes such as carnauba, spermaceti, beeswax, lanolin and derivatives thereof;

(d) hydrophobic plant extracts;

(e) hydrocarbons such as liquid paraffins, vaseline, microcrystalline wax, ceresin, squalene, pristan and mineral oil;

(f) higher fatty acids such as lauric, myristic, palmitic, stearic, behenic, oleic, linoleic, linolenic, lanolic, isostearic and poly unsaturated fatty acids (PUFA);

(g) higher alcohols such as lauryl, cetyl, stearyl, oleyl, behenyl, cholesterol and 2-hexydecanol alcohol;

(h) esters such as cetyl octanoate, myristyl lactate, cetyl lactate, isopropyl myristate, myristyl myristate, isopropyl palmitate, isopropyl adipate, butyl stearate, decyl oleate, cholesterol isostearate, glycerol monostearate, glycerol distearate, glycerol tristearate, alkyl lactate, alkyl citrate and alkyl tartrate;

(i) essential oils such as mentha, jasmine, camphor, white cedar, bitter orange peel, ryu, turpentine, cinnamon, bergamot, citrus unshiu, calamus, pine, lavender, bay, clove, hiba, eucalyptus, lemon, starflower, thyme, peppermint, rose, sage, menthol, cineole, eugenol, citral, citronelle, borneol, linalool, geraniol, evening primrose, camphor, thymol, spirantol, penene, limonene and terpenoid oils;

(j) lipids such as cholesterol, ceramides, sucrose esters and pseudo-ceramides as described in European Patent Specification No. 556,957;

(k) vitamins such as vitamin A and E, and vitamin alkyl esters, including those vitamin C alkyl esters;

(I) sunscreens such as octyl methoxyl cinnamate (Parsol MCX) and butyl methoxy benzoylmethane (Parsol 1789);

(m) phospholipids; and (n) mixtures of any of the foregoing components.

A further requirement of the benefit agent composition of the invention is that the composition have a viscosity of over 10,000 centipoise. This viscosity may be present because an individual emollient may have a viscosity above this range or because emollients of lower viscosity have been thickened to have such viscosity.

A particularly preferred benefit agent is silicone, specifically, as noted, silicones having viscosity greater than about 10,000 centipoise. The silicone may be a gum and/or it may be a mixture of silicones. One example is polydimethylsiloxane having viscosity of about 60,000 centistokes.

The benefit agent generally comprises about 1% to 70%, preferably 30% to 60%, most preferably 40% to 60% by weight of the powder composition. As noted above, if the benefit agent comprises 50% of the powder and powder is 20% of the powder/chip mixture which is extruded to form final bars (i.e., 20% powder/80% chips), benefit agent loading is 10%.

Carrier

In one embodiment, the carrier component can be any water soluble starch including both partially soluble starches (such as corn or potato starch) and, more preferably, "true" water soluble starches, i.e., starches in which at least 10% by wt. or greater solution of starch in water will dissolve to form a clear or substantially clear solution. Examples of such include maltodextrin. Maltodextrin is particularly preferred.

In another embodiment, the carrier may be a water soluble amorphous solid such as, for example, alkali metal caseinate (e.g., sodium caseinate).

The carrier may also be a semi-crystalline water soluble solid such as, for example, gelatin.

The carrier of the invention should have melting point above 80° C., preferably above 100° C. While not wishing to be bound by theory, it is believed that carriers with such high melting points can successfully survive the spray drying powder production process without forming a gooey, insoluble mixture. It should be understood that, if prepared in a full scale spray drier, lower melting point carriers (in theory as low as room temperature) could be used. That is, all that is required is that the temperature of carrier need be above the temperature of the drying chamber in which the adjuvant is formed.

The carrier compound generally will comprise about 15% to 98%, preferably 30% to 50% of the powder composition.

Water

A third component of the powder composition is water which generally comprise about 1 to 10% of the powder. It should be noted that for some materials, it may not be necessary to have extremely low water, even if some additional water is needed (e.g., to enhance powder flow) because the powder may be hygroscopic in any event.

Deposition/Processing Aid

An optional component of the powder composition is a deposition/processing aid which is selected from the group consisting of (1) anionic, cationic, nonionic and amphoteric surfactants; (2) cationic polymers; and (3) hydrophilic polymers.

The surfactant aids of group (1) can be any one of dozens of suitable surfactants including, but not limited to, the following: alkyl ether sulphates; alkyl ethoxylates; alkyl ethoxy carboxylates; alkyl glyceryl ether sulphonates; alpha olefin sulphonates; acyl taurides; methyl acyl taurates; N-acyl glutamates; acyl isethionates; anionic acyl sarcosinates; alkyl phosphates; methyl glucose esters; protein condensates; ethoxylated alkyl sulphates; alkyl polyglucosides; alkyl amine oxides; betaines; sultaines; alkyl sulphosuccinates, dialkyl sulphosuccinates, acyl lactylates and mixtures thereof. The above mentioned detergents are preferably those based upon $C_8$ to $C_{24}$, more preferably those based upon $C_{10}$ to $C_{18}$ alkyl and acyl moieties.

Preferred surfactants include sulphosuccinates such as cocoamido sulfosuccinate; amido betaines such as cocoamidopropyl betaine; and aldonamides such as lactobionamides.

Cationic polymers which may be used include cationic polymers of the Polymer JR type (e.g., Polymer JR-400) made by Union Carbide; Merquat® Polymers such as Merquat 100 and Merquat 550 by Merck & Co; Jaguar® Polymer such as Jaguar® C-14-S by Stein Hall; Mirapol® Polymers such as Mirapol A15® by Miranol Chemicals.

Other suitable cationic polymers may include copolymers of dimethylaminoethylmethacrylate and acrylamide and copolymers of dimethyldialylammonium chloride and acrylamide in which ratio of cationic to neutral nonionics is selected to give copolymers a cationic charge. Other suitable cationic polymers include cationic starches, e.g. StaLok® 300 and 400 made by Staley,Inc.

More cationic polymers which may be used are described in U.S. Pat. No. 4,438,094 to Grollier/Allec, issued Mar. 20, 1984. This reference is hereby incorporated by reference into the subject application.

Hydrophilic polymers which may be used include polyalkylene glycols having molecular weight of 1450 to 150,000, for example PEG 8000 from Union Carbide.

The above ingredients may comprise about 0 to 30%, preferably 0 to 15% of the powder composition.

Preparation

The powder adjuvants of the invention are generally, although not necessarily, prepared by preparing a mixture of benefit agent (usually as an emulsion), water soluble carrier (e.g., maltodextrin) and optional deposition/processing aid to form a slurry.

As noted, the benefit agents are generally incorporated into the slurry as emulsions. These emulsions are either supplied or can be made in lab depending on availability and benefit agents of interest. For example silicone is easily obtained as an emulsion from Dow® whereas mineral oil is more easily emulsified in the lab. Emulsions usually contain 30%–50% internal phase, i.e., benefit agent, 2%–10% emulsifier and the remaining water.

The carrier is usually prepared as a solution and it is generally preferred to add the deposition/processing aid (if used) to this carrier solution. For example, starch can be prepared as a solution, usually containing the deposition/processing aid. More specifically, maltodextrin, for example, may be prepared as a 50% solution, maintained at 60°–70° C. and, while stirred with an overhead mixer, the deposition/processing aid, if any, can be added to the maltodextrin solution.

Generally, the benefit agent emulsion and carrier process aid solution are mixed, diluted to about 70% water and heated to about 70° C. It should be noted that dilution is used only to ensure viscosity is low enough to pump on a laboratory scale. In larger scale up, where higher viscosity fluids can be maintained more readily, the dilution is not necessarily required. The final slurry is then pumped to a drying means, e.g., a spray drier.

If a spray drier is used, the slurry is pumped into a tube where the nozzle of the tube can be from 80° C. to 200° C., preferably 100° C. to 200° C. At the end of the nozzle, the slurry is atomized by the concurrent flow of high pressure air. Subsequently the water is vaporized leaving behind a free flowing powder trapping the benefit agent.

Thus, in general, preparation of powder comprises mixing carrier and benefit agent at 40° C. to 80° C., preferably 50° C. to 70° C., passing the mixture through spray drier at nozzle temperature of 80°–200° C., preferably 100° C. to 200° C. at pressure of 0.10–0.30 MPa and collecting the resulting powder.

A typical finished adjuvant will contain 0% to 30% deposition/processing aid, 1% to 70% benefit agent, 30% to 98% carrier and 1% to 10% water.

The final powder is then placed into a bar by first chip mixing in an amalgamator. The adjuvant powder and personal wash chips are then extruded into billets with conventional equipment and pressed into bars. Bars with the adjuvant display enhanced deposition of benefit agent over those bars in which the benefit agent is added directly to the bar during its mixing stage.

Surfactant Chips

As noted, about 1% to 30% of the adjuvant is used in the final bar. The remaining ingredients forming final bar compositions (i.e., about 99 to 70% chips) comprise chips which generally comprise the surfactant system defining the bar.

Specifically, the surfactant system chips comprise about 5% to 90% by wt. of a surfactant system wherein the surfactant is selected from the group consisting of soap (pure soap surfactant systems are included), anionic surfactant, nonionic surfactant, amphoteric/zwitterionic surfactant, cationic surfactant and mixtures thereof. These chips may additionally comprise other components typically found in final bar compositions, for example, minor amounts of fragrance, preservative, skin feel polymer etc.

Surfactant System

The term "soap" is used herein in its popular sense, i.e., the alkali metal or alkanol ammonium salts of aliphatic alkane- or alkene monocarboxylic acids. Sodium, potassium, mono-, di- and tri-ethanol ammonium cations, or combinations thereof, are suitable for purposes of this invention. In general, sodium soaps are used in the compositions of this invention, but from about 1% to about 25% of the soap may be potassium soaps. The soaps useful herein are the well known alkali metal salts of natural of synthetic aliphatic (alkanoic or alkenoic) acids having about 12 to 22 carbon atoms, preferably about 12 to about 18 carbon atoms. They may be described as alkali metal carboxylates of acrylic hydrocarbons having about 12 to about 22 carbon atoms.

Soaps having the fatty acid distribution of coconut oil may provide the lower end of the broad molecular weight range. Those soaps having the fatty acid distribution of peanut or rapeseed oil, or their hydrogenated derivatives, may provide the upper end of the broad molecular weight range.

It is preferred to use soaps having the fatty acid distribution of coconut oil or tallow, or mixtures thereof, since these are among the more readily available fats. The proportion of fatty acids having at least 12 carbon atoms in coconut oil soap is about 85%. This proportion will be greater when mixtures of coconut oil and fats such as tallow, palm oil, or non-tropical nut oils or fats are used, wherein the principle chain lengths are $C_{16}$ and higher. Preferred soap for use in the compositions of this invention has at least about 85% fatty acids having about 12 to 18 carbon atoms.

Coconut oil employed for the soap may be substituted in whole or in part by other "high-alluric" oils, that is, oils or fats wherein at least 50% of the total fatty acids are composed of lauric or myristic acids and mixtures thereof. These oils are generally exemplified by the tropical nut oils of the coconut oil class. For instance, they include: palm kernel oil, babassu oil, ouricuri oil, tucum oil, cohune nut oil, murumuru oil, jaboty kernel oil, khakan kernel oil, dika nut oil, and ucuhuba butter.

A preferred soap is a mixture of about 15% to about 20% coconut oil and about 80% to about 85% tallow. These mixtures contain about 95% fatty acids having about 12 to about 18 carbon atoms. The soap may be prepared from coconut oil, in which case the fatty acid content is about 85% of $C_{12}$–$C_{18}$ chain length.

The soaps may contain unsaturation in accordance with commercially acceptable standards. Excessive unsaturation is normally avoided.

Soaps may be made by the classic kettle boiling process or modern continuous soap manufacturing processes wherein natural fats and oils such as tallow or coconut oil or their equivalents are saponified with an alkali metal hydroxide using procedures well known to those skilled in the art. Alternatively, the soaps may be made by neutralizing fatty acids, such as lauric ($C_{12}$), myristic ($C_{14}$), palmitic ($C_{16}$), or stearic ($C_{18}$) acids with an alkali metal hydroxide or carbonate.

The anionic detergent active which may be used may be aliphatic sulfonates, such as a primary alkane (e.g., $C_8$–$C_{22}$) sulfonate, primary alkane (e.g., $C_8$–$C_{22}$) disulfonate, $C_8$–$C_{22}$ alkene sulfonate, $C_8$–$C_{22}$ hydroxyalkane sulfonate or alkyl glyceryl ether sulfonate (AGS); or aromatic sulfonates such as alkyl benzene sulfonate.

The anionic may also be an alkyl sulfate (e.g., $C_{12}$–$C_{18}$ alkyl sulfate) or alkyl ether sulfate (including alkyl glyceryl ether sulfates) among the alkyl ether sulfates are those having the formula:

$$RO(CH_2CH_2O)_nSO_3M$$

wherein R is an alkyl or alkenyl having 8 to 18 carbons, preferably 12 to 18 carbons, n has an average value of greater than 1.0, preferably greater than 3; and M is a solubilizing cation such as sodium, potassium, ammonium or substituted ammonium. Ammonium and sodium lauryl ether sulfates are preferred.

The anionic may also be alkyl sulfosuccinates (including mono- and dialkyl, e.g., $C_6$–$C_{22}$ sulfosuccinates); alkyl and acyl taurates, alkyl and acyl sarcosinates, sulfoacetates, $C_8$–$C_{22}$ alkyl phosphates and phosphates, alkyl phosphate esters and alkoxyl alkyl phosphate esters, acyl lactates, $C_8$–$C_{22}$ monoalkyl succinates and maleates, sulphoacetates, alkyl glucosides and acyl isethionates.

Sulfosuccinates may be monoalkyl sulfosuccinates having the formula:

$$R^4O_2CCH_2CH(SO_3M)CO_2M;$$

and amide-MEA sulfosuccinates of the formula;

$$R^4CONHCH_2CH_2O_2CCH_2CH(SO_3M)CO_2M$$

wherein $R^4$ ranges from $C_8$–$C_{22}$ alkyl and M is a solubilizing cation.

Sarcosinates are generally indicated by the formula:

$$R'CON(CH_3)CH_2CO_2M,$$

wherein $R^1$ ranges from $C_8$–$C_{20}$ alkyl and M is a solubilizing cation.

Taurates are generally identified by formula:

$$R^2CONR^3CH_2CH_2SO_3M$$

wherein $R^2$ ranges from $C_8$–$C_{20}$ alkyl, $R^3$ ranges from $C_1$–$C_4$ alkyl and M is a solubilizing cation.

Particularly preferred are the $C_8$–$C_{18}$ acyl isethionates. These esters are prepared by reaction between alkali metal isethionate with mixed aliphatic fatty acids having from 6 to 18 carbon atoms and an iodine value of less than 20. At least 75% of the mixed fatty acids have from 12 to 18 carbon atoms and up to 25% have from 6 to 10 carbon atoms.

Acyl isethionates, when present, will generally range from about 10% to about 70% by weight of the total bar composition. Preferably, this component is present from about 30% to about 60%.

The acyl isethionate may be an alkoxylated isethionate such as is described in llardi et al., U.S. Pat. No. 5,393,466, hereby incorporated by reference. This compound has the general formula:

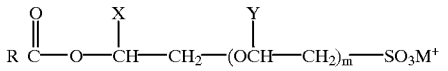

wherein R is an alkyl group having 8 to 18 carbons, m is an integer from 1 to 4, X and Y are hydrogen or an alkyl group having 1 to 4 carbons and $M^+$ is a monovalent cation such as, for example, sodium, potassium or ammonium.

Amphoteric detergents which may be used in this invention include at least one acid group. This may be a carboxylic or a sulphonic acid group. They include quaternary nitrogen and therefore are quaternary amido acids. They should generally include an alkyl or alkenyl group of 7 to 18 carbon atoms. They will usually comply with an overall structural formula:

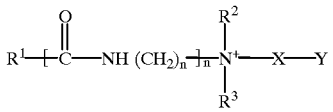

where $R^1$ is alkyl or alkenyl of 7 to 18 carbon atoms;

$R^2$ and $R^3$ are each independently alkyl, hydroxyalkyl or carboxyalkyl of 1 to 3 carbon atoms;

m is 2 to 4;

n is 0 to 1;

X is alkylene of 1 to 3 carbon atoms optionally substituted with hydroxyl, and Y is —$CO_2$— or —$SO_3$—

Suitable amphoteric detergents within the above general formula include simple betaines of formula:

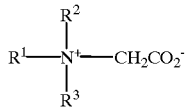

and amido betaines of formula:

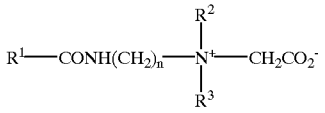

where n is 2 or 3.

In both formulae $R^1$, $R^2$ and $R^3$ are as defined previously. $R^1$ may in particular be a mixture of $C_{12}$ and $C_{14}$ alkyl groups derived from coconut so that at least half, preferably at least three quarters of the groups $R^1$ have 10 to 14 carbon atoms. $R^2$ and $R^3$ are preferably methyl.

A further possibility is that the amphoteric detergent is a sulphobetaine of formula:

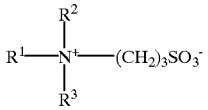

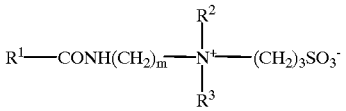

where m is 2 or 3, or variants of these in which $—(CH_2)_3SO_3^-$ is replaced by

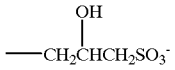

In these formulae $R^1$, $R^2$ and $R^3$ are as discussed previously.

The nonionic which may be used as the second component of the invention include in particular the reaction products of compounds having a hydrophobic group and a reactive hydrogen atom, for example aliphatic alcohols, acids, amides or alkylphenols with alkylene oxides, especially ethylene oxide either alone or with propylene oxide. Specific nonionic detergent compounds are alkyl ($C_6$–$C_{22}$) phenols ethylene oxide condensates, the condensation products of aliphatic ($C_8$–$C_{18}$) primary or secondary linear or branched alcohols with ethylene oxide, and products made by condensation of ethylene oxide with the reaction products of propylene oxide and ethylenediamine. Other so-called nonionic detergent compounds include long chain tertiary amine oxides, long chain tertiary phosphine oxides and dialkyl sulphoxides.

The nonionic may also be a sugar amide, such as a polysaccharide amide. Specifically, the surfactant may be one of the lactobionamides described in U.S. Pat. No. 5,389,279 to Au et al. which is hereby incorporated by reference or it may be one of the sugar amides described in U.S. Pat. No. 5,009,814 to Kelkenberg, hereby incorporated into the subject application by reference.

Examples of cationic detergents are the quaternary ammonium compounds such as alkyldimethylammonium halogenides.

Other surfactants which may be used are described in U.S. Pat. No. 3,723,325 to Parran Jr. and "Surface Active Agents and Detergents" (Vol. I & II) by Schwartz, Perry & Berch, both of which are also incorporated into the subject application by reference.

Although the bar may be a pure soap bar, preferably the surfactant system of this chip (forming the surfactant system in the bar) comprises:

(a) a first synthetic surfactant which is anionic; and (b) a second synthetic surfactant selected from the group consisting of a second anionic different from the first, a nonionic, an amphoteric and mixtures thereof.

The first anionic can be any of those recited above, but is preferably a $C_8$ to $C_{18}$ isethionate as discussed above. Preferably acyl isethionate will comprise 10% to 90% by wt., preferably 10% to 70% total bar composition.

The second surfactant is preferably a sulfosuccinate, a betaine or mixtures of the two. The second surfactant or mixture of surfactant will generally comprise 1% to 10% total bar composition. A particularly preferred composition comprises enough sulfosuccinate to form 3–8% total bar compositions and enough betaine to form 1–5% of total bar composition.

Processing

The adjuvants of the invention are combined with the "surfactant" chips in a hopper or ribbon mixer where they may be refined (e.g., worked into a more pliable mass), plodded into billets, stamped and cut.

Except in the operating and comparative examples, or where otherwise explicitly indicated, all numbers in this description indicating amounts of material or conditions of reactions and/or use are to be understood as modified by the word "about".

The following examples are intended to further illustrate the invention and are not intended to limit the invention in any way.

Unless stated otherwise, all percentages are intended to be percentages by weight.

EXAMPLE 1

Bar Preparation with Spray Dried Adjuvant

Slurry Preparation: In a large beaker, 232.5 gm of water was heated to over 40° C. 232.5 gm of maltodextrin were added, with agitation and the mixture was mixed and heated until the solution was clear. 6.2.5 gm of cationic polymer Merquat 100, 40% active was then added. Once homogeneous, 465 gm of Dow 1650 silicone emulsion (50% active with 60,000 cps internal phase) was added and temperature was maintained at 50°–70° C. In instances where the mixture was too thick to pump, an additional 640.8 gm of water was added to bring the total mixture to 70% water.

Powder Manufacture: The mixture was then pumped through a Yamato, Pulvis GB 22 mini lab scale spray drier. The inlet temperature was set to 200° C. and the atomization pressure was set at 0.15 MPa. The resulting powder was collected from the cyclone collector off from the bottom of the drying chamber. In this case, this spray nozzle size was not important. The nozzle is a concurrent flow type nozzle.

Bar Preparation: The powder produced from spray drying was incorporated into a bar matrix through the following procedure:

(1) 4 lbs. of Dove chips and 1 lb. of spray dried powder were dry mixed either in a large enough container or an amalgamator.

(2) The mixture was passed through a Weber-Selander two stage plodder where noodles were produced in the first stage and a billet was formed in the second.

(3) The billet was cut to a length which fit the bar die in the press and was used to form a bar.

The resulting bar contained approximately 9.3% 60,000 cps poly(dimethyl siloxane).

In Vitro Deposition Testing

Samples were treated by rubbing the bar across a 25 $cm^2$ piece of wet pigskin 10 times, lathering the resultant liquor for 30 seconds and then rinsing the skin for 10 seconds under 90–95° F. water. The treated pigskin was then placed in a vial and the silicone was extracted with 10 mis of xylene. Next, the skin was removed from the vial and the extracted solvent was analyzed for silicone by Inductively Coupled Plasma Atomic Emission Spectroscopy.

The following are deposition results:

| Adjuvant | A | B | C |
|---|---|---|---|
| 60,000 cps PDMS | 49% | 48.85% | 48.7% |
| Maltodextrin | 49% | 48.85% | 48.7% |
| Merquat 100 | 0.0% | 0.3% | 0.6% |
| Water | 2.0% | 2.0% | 2.0% |
| 80% Dove/20%A | 80% Dove/20%B | 80% Dove/20%C | |
| 2.4 $\mu g/cm^2 \pm 0.6$ | 2.4 $\mu g/cm^2 \pm 1.0$ | 2.4 $\mu g/cm^2 \pm 0.7$ | |

The deposition of silicone onto the pigskin is comparable to what is delivered for shower gels.

Additional Examples of Spray Dried Powders

| | Weight Percents | | | | | | | | | |
|---|---|---|---|---|---|---|---|---|---|---|
| Component | 1 | 2 | 3 | 4 | 5 | 6 | 7 | 8 | 9 | 10 |
| Maltodextrin | 49 | 46 | 46 | 46 | 46 | 46 | | | 24 | 49 |
| Gelatin | | | | | | | | 49 | | |
| Na Caseinate | | | | | | | 49 | | | |
| PDMS* | 49 | 46 | 46 | 46 | 46 | 46 | 49 | 49 | 70 | |
| Geahlene** | | | | | | | | | | 49 |
| PEG 8000 | | | 5 | | | | | | | |
| Lactobionamide | | | | 5 | | | | | 4 | |
| CAPB*** | | | | | 5 | | | | | |
| CAS**** | | | | | | 5 | | | | |
| Merquat 100 | | 5 | | | | | | | | |

*polydimethyl siloxane 60,000 centipoise
**commercially available thickened mineral oil 50,000 centipoise
***cocoamidopropyl betaine
****cocoamido sulfosuccinate Columns do not add up to 100. The remainder is water.

We claim:

1. A bar composition comprising about 1% to 30% by wt. bar composition of an adjuvant powder comprising by weight of adjuvant powder:

(a) 1% to 70% benefit agent;

(b) 15% to 98% carrier having a melting point above a temperature in a drying chamber in which said adjuvant powder is formed;

(c) about 1% to 10% water; and (d) 0% to 30% of a deposition/processing aid selected from the group consisting of (i) anionic, cationic, nonionic and amphoteric surfactants;

(ii) cationic polymers; and (iii) hydrophilic polymers;

and about 99% to 70% by wt. bar composition of chips comprising 5% to 90% by wt. of said chips of a surfactant system wherein the surfactant is selected from the group consisting of soap, anionic surfactant, nonionic surfactant, amphoteric surfactant, cationic surfactant and mixtures thereof;

wherein said benefit agent (a) is in the form of an emulsion and wherein said emulsion comprises:

(i) 30 to 50% benefit agent;

(ii) 2 to 10% emulsifier; and (iii) balance water;

wherein said adjuvant powder is made by a spray drying process and wherein said bar is made by dry mixing said adjuvant powder and said chips to obtain a mixture; plodding said mixture into billets; and cutting said billets into bars.

2. A composition according to claim 1, wherein the carrier is a partially soluble starch selected from the group consisting of corn and potato starches.

3. A composition according to claim 1, wherein the carrier is a starch in which 10% by wt. or greater of solution of starch in water will dissolve to form a clear or substantially clear solution.

4. A composition according to claim 3, wherein the starch is maltodextrin.

5. A composition according to claim 1, wherein the carrier is a water soluble amorphous solid.

6. A composition according to claim 5, wherein the carrier is alkali metal caseinate.

7. A composition according to claim 1, wherein the carrier is a semi-crystalline water soluble solid.

8. A composition according to claim 7, wherein the carrier is gelatin.

9. A composition according to claim 1, wherein carrier has a melting point above 80° C.

10. A composition according to claim 9, wherein the carrier has melting point above 100° C.

11. A composition according to claim 1, wherein the deposition/processing aid is a surfactant selected from the group consisting of sulfosuccinate, amido betaine and aldonamides.

12. A composition according to claim 1, wherein the hydrophilic polymer is polyalkylene glycol having a molecular weight of 1450 to 150,000.

* * * * *